US006827994B2

(12) United States Patent
Ellman et al.

(10) Patent No.: US 6,827,994 B2
(45) Date of Patent: Dec. 7, 2004

(54) PORTABLE WEIGHTED GRIPPING DEVICE

(76) Inventors: Avi Ellman, 12 Celia Ct., Suffern, NY (US) 10901; Brent Coetzee, 5055 Collins Ave., Apt. 9f, Miami Beach, FL (US) 33140

( * ) Notice: Subject to any disclaimer, the term of this patent is extended or adjusted under 35 U.S.C. 154(b) by 0 days.

(21) Appl. No.: 10/318,722

(22) Filed: Dec. 13, 2002

(65) Prior Publication Data

US 2003/0140466 A1 Jul. 31, 2003

Related U.S. Application Data

(60) Provisional application No. 60/341,131, filed on Dec. 13, 2001.

(51) Int. Cl.[7] ..... B32B 3/10; B32B 1/02

(52) U.S. Cl. ..... 428/34.1; 428/99; 428/136; 248/500; 248/508; 135/118

(58) Field of Search ..... 428/99, 136, 34.1; 24/545, 563, 30.5 S; 52/4, 155; 135/118; 248/545, 508, 500; 5/417–419

(56) References Cited

U.S. PATENT DOCUMENTS 4,644,610 A * 2/1987 Fish ..... 24/30.5 S
4,927,118 A * 5/1990 Pierorazio ..... 248/545
5,474,275 A * 12/1995 Robertson et al. ..... 248/508

* cited by examiner

*Primary Examiner*—Alexander S. Thomas
(74) *Attorney, Agent, or Firm*—Wolf, Greenfield & Sacks, P.C.

(57) ABSTRACT

A means for securing a beach towel or blanket or the like on a beach, lawn or the like, having a container sized to receive a weight such as sand, and a slotted diaphragm of flexible resilient material shaped to receive and secure the edge or corner of the towel or blanket.

5 Claims, 5 Drawing Sheets

SCALE 2.000

PORTABLE WEIGHTED GRIPPING DEVICE

PRIOR RELATED APPLICATIONS

This application claims priority of Application Ser. No. 60/341,131, filed Dec. 13, 2001.

SUBJECT MATTER OF THE INVENTION

The invention relates to a means for securing a fabric material such as a towel or a blanket. In particular, the present invention is particularly directed to a means for securing fabric material such as a towel or blanket on beaches, lawns or at the pool or other similar settings from windblown or other inadvertent movement.

BACKGROUND OF THE INVENTION

Towels, blankets and other coverings frequently used on beaches or lawns are often moved and disturbed by wind or movement of people over the blanket or towel. To avoid this problem, it is common to place stones or other weights on the corners of towels or blankets. In some instances, pegs have been used to secure the blankets in place. These and other means and methods of securing beach blankets and the like have not been altogether satisfactory. Frequently stones are not available or are not secure enough and fall off the edges of the blankets. Frequently spikes are made of plastic, easily break or cannot penetrate the ground without unreasonable amounts of pressure and frequently require complicated structures to engage the fabric. Additionally, securing the edges or corners of a blanket or towel presents additional problems which often involve clamps or moving parts to secure the blanket.

SUBJECT MATTER OF THE INVENTION

The present invention is designed to overcome the foregoing problems and provides a simple inexpensive mechanism for securing beach blankets and the like on a beach, lawn or similar setting. The present invention provides a securing means suitable for use on lawns, hard surfaces, sand, and the like. It provides a simple means for securing the edge or corner of a towel or blanket and further is shaped and sized to provide a sufficiently weighted component to firmly secure the corner or edge of the towel or blanket position.

The present invention is further designed to have multiple functions since it may be designed for advertising purposes. Thus, for example, the unit may be designed in a wide range of shapes for advertising purposes such as a shape of a beer, soda can, bottle, tennis ball, football, golf ball, soccer ball, basketball, or the like. It may also have unusual shapes such as the shape of a hamburger or a hotdog. Such variety of shapes particularly lend themselves for advertising purposes with an advertisers mark or logo suitably printed, screen or formed on the items.

The present invention may be formed of injected molded material with little or substantially no assembly requirements. It, thus, provides a relatively inexpensive but sturdy means for securing the edge or the corner of a blanket.

DESCRIPTION OF THE DRAWINGS

The foregoing objects and advantages of the present invention will be more clearly understood when considered in connection with the accompanying drawings in which.

DETAILED DESCRIPTION OF PREFERRED EMBODIMENT

Figure 3:
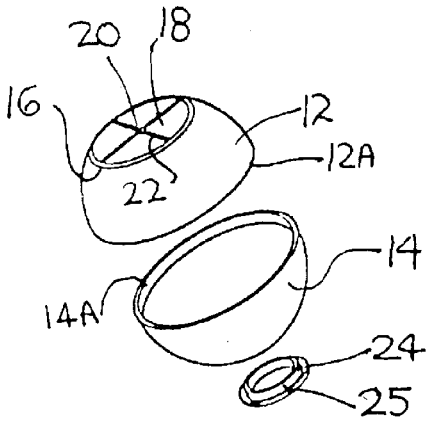
FIG. 3 is an exploded, perspective view of the embodiment shown in FIG. 1.
Figure 1:
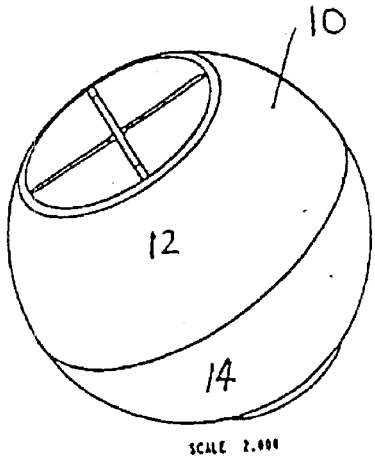
FIG. 1 is a top perspective view of a preferred means for securing fabric embodying the invention.
Figure 2:
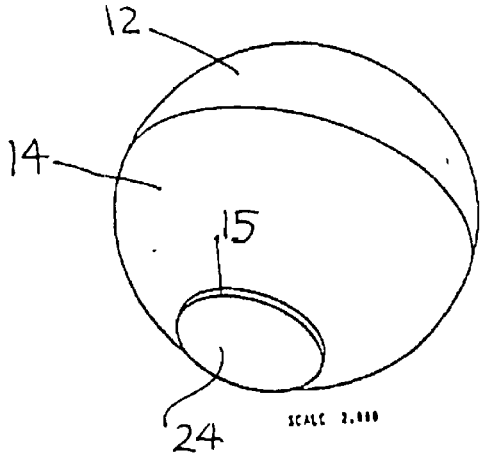
FIG. 2 is a perspective bottom view of the embodiment of FIG. 1.

Referring to the embodiments of FIGS. 1–3, there is illustrated a container 10, which as illustrated in this embodiment is essentially spherical in appearance. However, cylindrical, rectangular prisms, pyramid, or other shape containers may be used. For example, for purposes of using these devices for promotional purposes, the containers may have the shape of a soda can, beer can, soft drink bottle, hamburger, hot dog, or other configuration provided it has sufficient volume to contain a weight heavy enough to hold the corner or edge of the fabric engaged by the shape against windblown movement.

The container 10 may be injection molded of polystyrene, polyethylene or any other suitable plastic material as is conventional in the art. As illustrated, the container 10 may be molded of two spheres 12 and 14 which are formed with a conventional interengageable shoulder 12*a* and interengageable recess 14*a* for snap fit interengagement. The two halves 12 and 14 of the container 10 may be heat-sealed or otherwise permanently secured together to form a closed container; in this case a sphere shape.

An opening 16 is formed in the container 10. In the embodiment illustrated, this opening may have a diameter of about half the diameter of the container 10. The opening 16 is formed with a flexible, deformable diaphragm 18 made of suitable material such as rubber, synthetic rubber or the like. In a preferred embodiment, the diaphragm 18 should be relatively stiff and have a thickness in the order of ⅛ inch. The diaphragm 18 is formed with at least one and preferably two die cuts or slits 20 and 22 extending orthogonally across the diaphragm 48. These slits or cuts 20, 21, are designed to permit deflection of the diaphragm and insertion of a corner or an edge of a towel, blanket, or a fabric between the edges of the slits. The fabric is resiliently secured by the frictional engagement of the edges formed by the slits 20 and 22, with the fabric held securely in position by the stiffness of the diaphragm unless pulled out with a positive force. The particular parameters of the stiffness of the diaphragm and the size of the slits may be varied depending upon the particular purposes for which the unit is intended.

A hole 15 (FIG. 2) is formed in the bottom of the half 14 and is shaped to receive a cover 24 in a snap fit. The cover 24 may be conventionally designed to snap fit into the hole and be secured in the hole against inadvertent removal by upstanding flange 25 which frictionally engages the inner surface of hole 15. The fabric securing means or device, when in use, is filled with a heavy material such as sand by removing the cover 24, inserting the sand until at least half the container is filled, and then closing the opening by snapping the cover 24 into hole 15. The device functions as a weighted unit with the slits 20, 22 designed to frictionally engage and secure the edge or corner of a blanket or towel. Preferably the device as illustrated in FIGS. 1 and 2 are about half filled with sand. Four or more of these units may be provided to secure a towel or a blanket. For example, a large blanket may be secured by inserting each corner of the blanket in a different one of these units. The corner of the blanket will thus be heavily weighed and the blanket will thus remain firmly in place on a beach or on a lawn. Additional units or devices may be used along the edges of the blanket.

Figure 4:
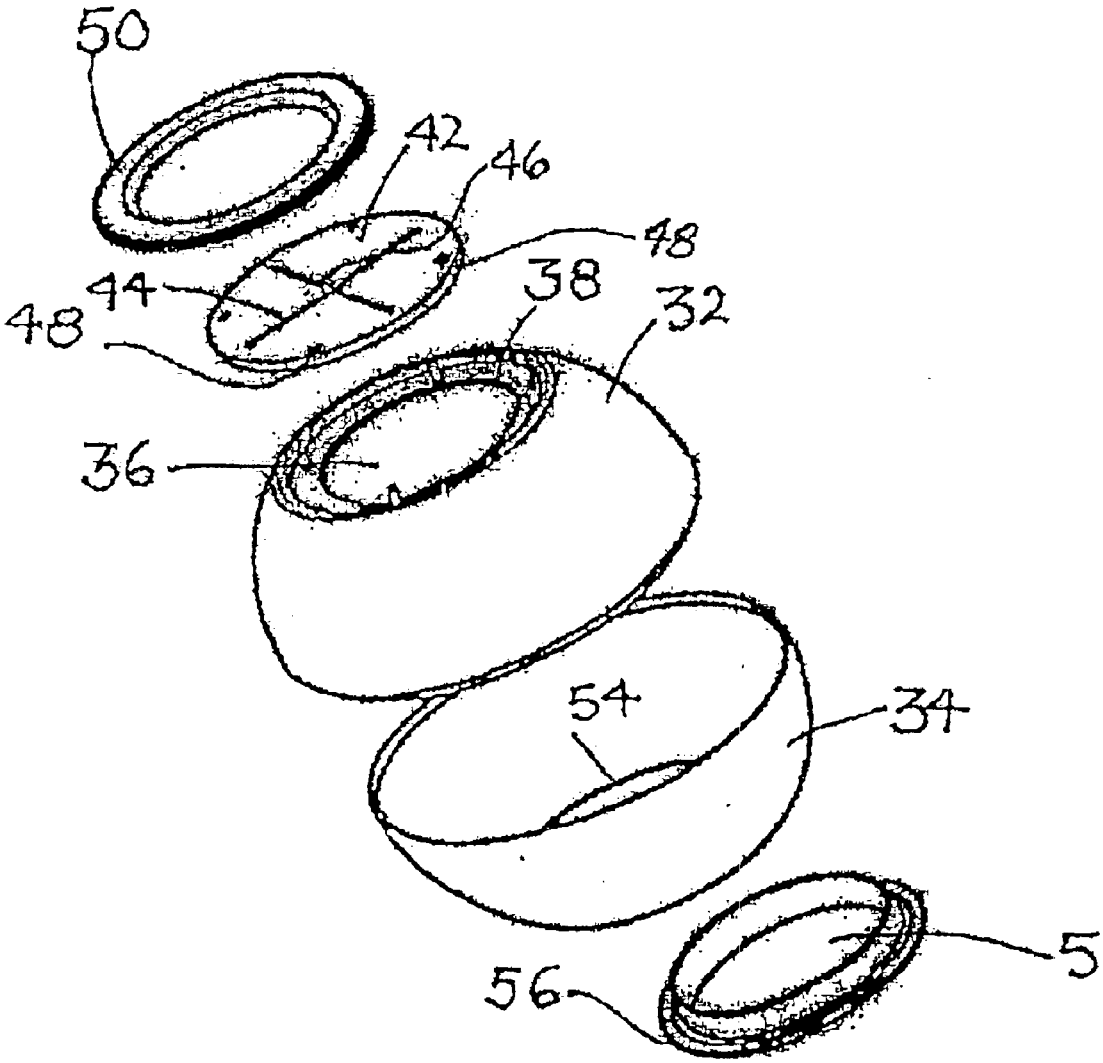
FIG. 4 is an exploded view of an alternate embodiment.
Figure 5:
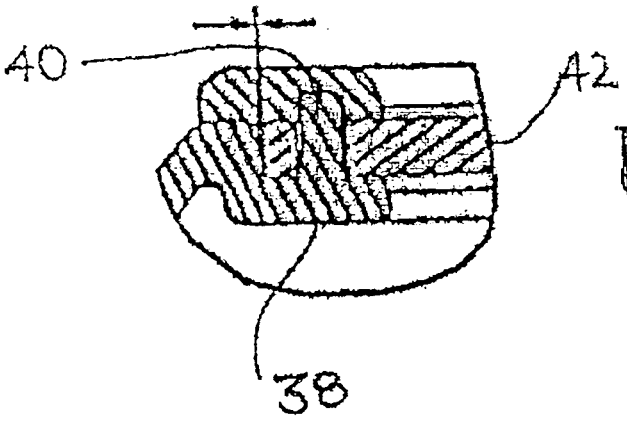
FIG. 5 is a cross-sectional detail of the diaphragm assembly of FIG. 4.
Figure 6:
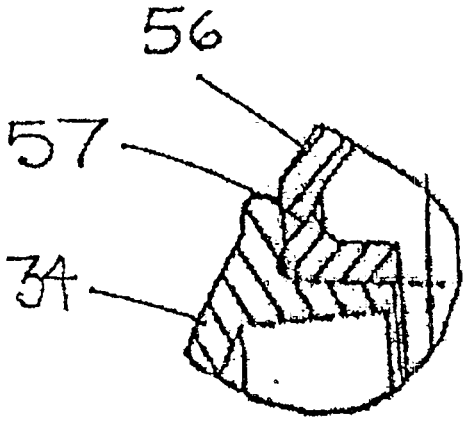
FIG. 6 is a cross-sectional detail of the cap or cover assembly.

An alternate embodiment of the invention is illustrated in FIGS. 4, 5 and 6. This embodiment is similar in overall configuration to the embodiment in FIG. 1 and has similar components including two halves, 32 and 34, similar in construction and style to the halves 12 and 14 of the embodiment in FIG. 1. An opening 36 is formed in the half shell 32. This opening 36 is defined by an inwardly extending annular flange 38 best illustrated in FIG. 5, this annular flange 32 is formed with a series of spaced bosses 40 (FIG. 5) which extend upwardly from the upper surface of the flange. A diaphragm 42 is formed with cross slots 44 and 46, as well as a series of holes 48. The holes 48 are shaped, sized, and spaced to engage the bosses 40 so the bosses 40 secure the diaphragm 42 securely in the opening 36. A retaining ring 50 is sized and shaped to snap fasten in a friction fit over the diaphragm 42 and may be secured there by suitable cement, heat seal or other securing means to permanently secure the diaphragm 42.

The bottom half 34 is formed with an opening 54 having an inwardly extending flange that frictionally engages the periphery 57 of cover 56 (see FIG. 6). The cover 56 may be formed with an outer periphery conforming to the opening so as to provide a snap fit closure as best illustrated in FIG. 6.

In use, a towel or blanket is secured to the units by engaging a corner or edge of the towel or blanket in the slots 44 and 46. This may be done by forcing the corner or edge of the towel through the slot until the slots frictionally engage the corner or edge of the towel or blanket. The interior of the container is at least partially filled with sand or the like through the opening 54 after which the cover 56 is secured. The amount of sand or other filler, such as stones, may vary depending on the particular needs presented for weighing the unit. By placing one of these units at each corner of the towel or blanket, the corners of the towels or blankets are weighed down and will not readily move. When used on the beach, these units may be partially buried in the sand to provide added securing means.

Figure 7:
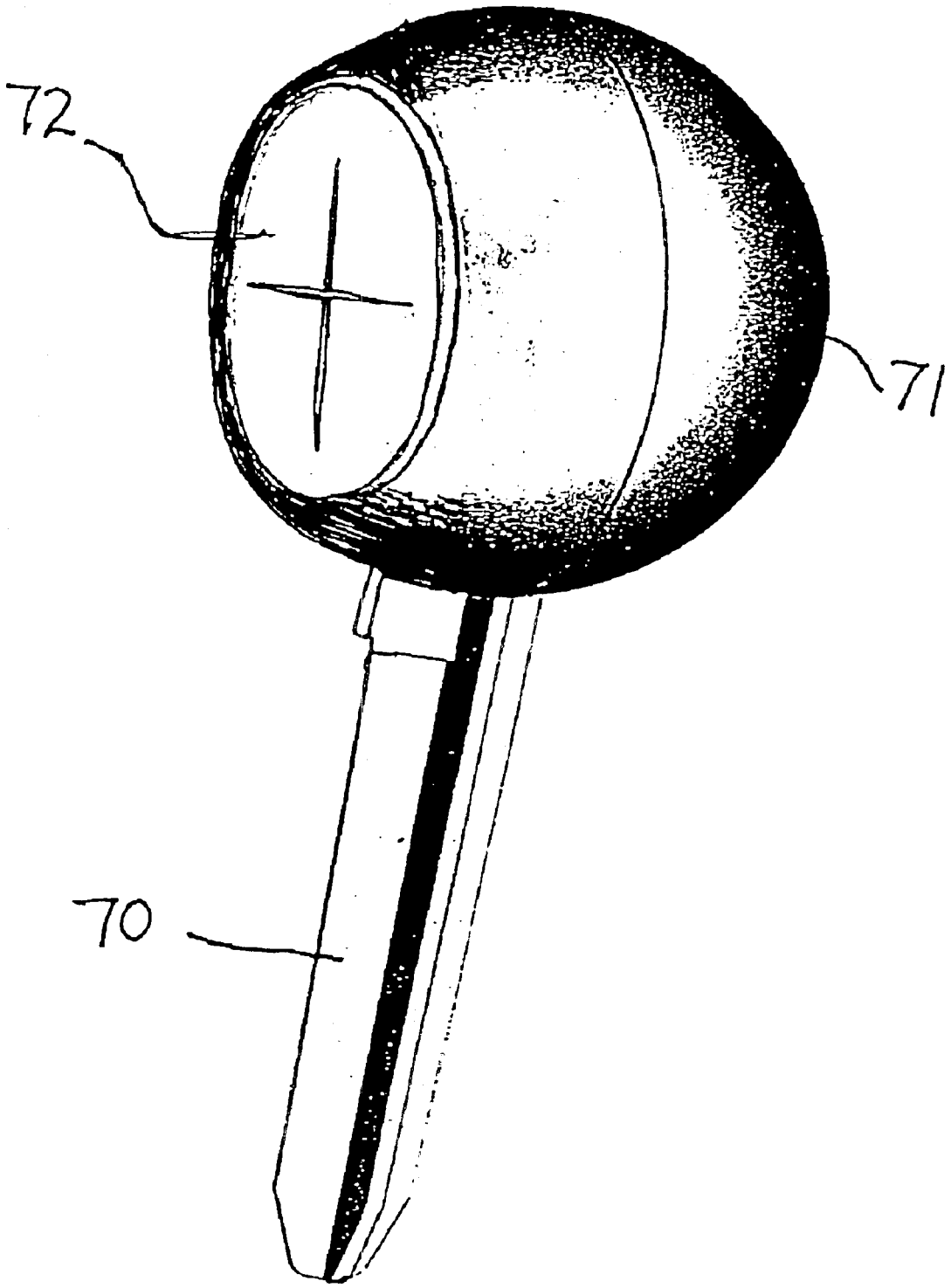
FIG. 7 is a perspective view of a further embodiment of the present invention.
Figure 8:
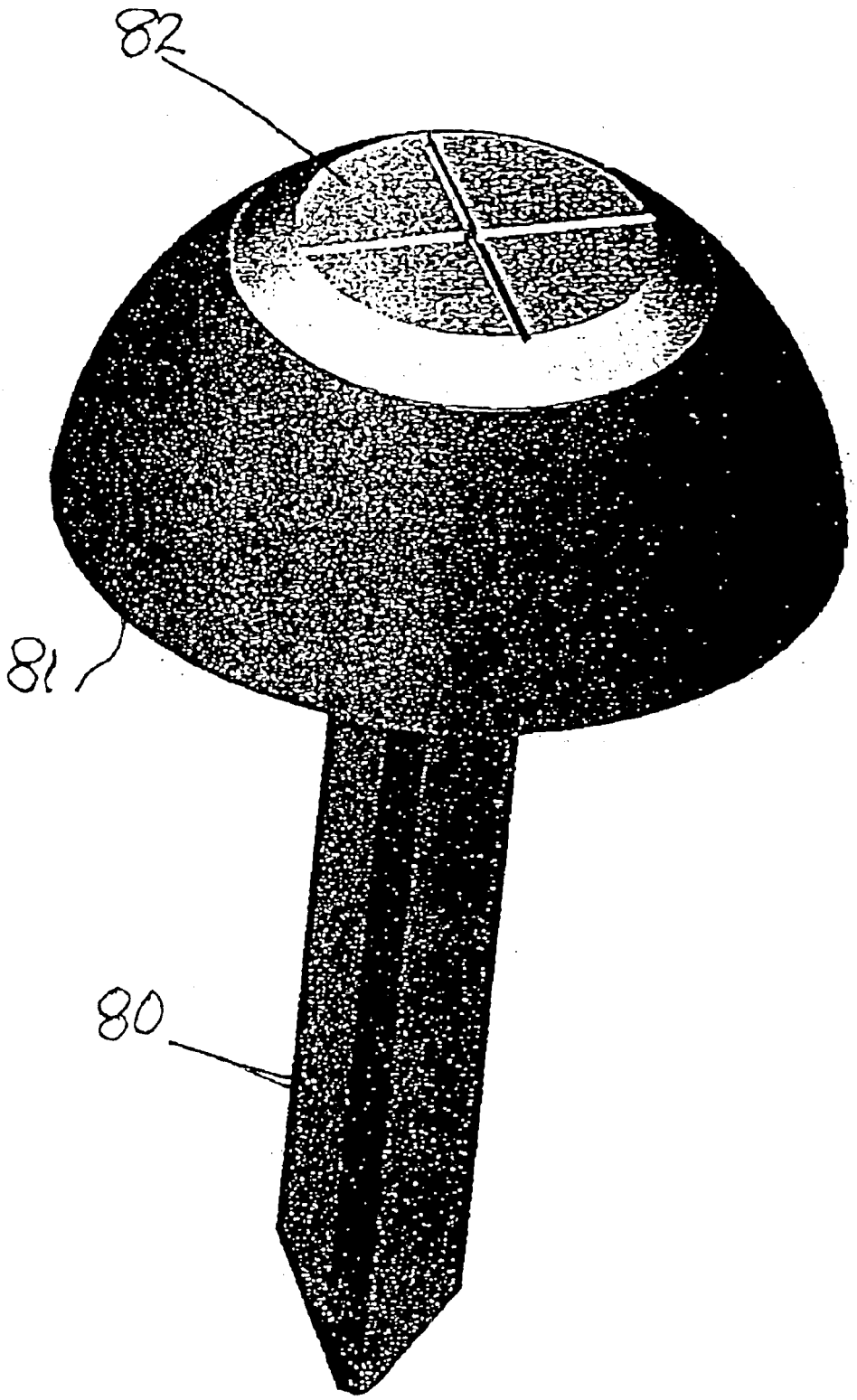
FIG. 8 is a perspective view of a still further embodiment of the present invention.

FIGS. 7 and 8 illustrate still further embodiments of the invention in which the principal means for securing the unit or device against undesired movement is provided by a spike 70 in FIG. 7 and 80 in FIG. 8. In each of these embodiments the spikes are integrally connected to containers 71 and 81 respectively, which are similar in function and purpose to container 10. The containers 71 and 81 may be shaped in a variety of shapes as previously described, but may also be designed not to be weighted. In such a modification the containers 71 and 81 function primarily as a support for diaphragms 72 and 82 respectively with the spikes 70 and 80 providing the primary means for securing the units shown in FIGS. 7 and 8. In FIG. 7 the diaphragm 72 is oriented on a side of the container 71 parallel to the length of the spike while in FIG. 8. The diaphragm 82 is oriented perpendicular to the length of the spike 80.

The diaphragms 72 and 82 are formed similarly and with similar material to diaphragms 18 and 42. Each is formed with orthogonal slots or the like similar to those in the previously described embodiments. The slots and diaphragm should provide sufficient flexibility and stiffness to permit deformation of the diaphragm to insert fabric through the slots in the diaphragm and thereafter the retention of the fabric by the stiffness of the diaphragm material.

We claim:

1. Means for limiting undesired movement of a fabric material on a surface, comprising:

a diaphragm formed of a flexible resilient material and having at least one slit extending at least partially across the diaphragm, sized to receive and secure a portion of the fabric material;

a container with the diaphragm extending across an opening in the container and secured to the periphery of the opening; and a second opening in the container and a cover removably secured to said second opening whereby weight may be inserted into the container and secured therein by closing the cover.

2. Means as set forth in claim 1 wherein the container holds the diaphragm generally in place relative to the surface.

3. Means as set forth in claim 1 wherein the container with said weight therein functions as at least a partial anchor for the fabric.

4. A means as set forth in claim 3 including a plurality of said means for limiting undesired movement of a fabric material spaced along the periphery of said fabric.

5. A device for securing the corner of a fabric sheet comprising a container having a pair of spaced openings, a diaphragm of flexible resilient material positioned over and secured to one opening, said diaphragm having at least one slit extending partially across the diaphragm and being deformable to receive and secure a corner of a fabric sheet, a removable cover for the second opening, and said container sized to receive a weight of material.

* * * * *